US010478020B2

(12) United States Patent
Navin

(10) Patent No.: US 10,478,020 B2
(45) Date of Patent: Nov. 19, 2019

(54) SOAP AND WATER DISPENSER FOR A TOILET STALL

(71) Applicant: Richard Navin, Baltimore, OH (US)

(72) Inventor: Richard Navin, Baltimore, OH (US)

( * ) Notice: Subject to any disclaimer, the term of this patent is extended or adjusted under 35 U.S.C. 154(b) by 0 days.

(21) Appl. No.: 15/944,518

(22) Filed: Apr. 3, 2018

(65) Prior Publication Data

US 2019/0298116 A1 Oct. 3, 2019

(51) Int. Cl.

| | |
|---|---|
| ***A47K 5/12*** | (2006.01) |
| ***E03C 1/05*** | (2006.01) |
| ***B05B 7/08*** | (2006.01) |
| ***B05B 7/00*** | (2006.01) |

(52) U.S. Cl.

CPC ..... *A47K 5/1217* (2013.01); *B05B 7/0018* (2013.01); *B05B 7/08* (2013.01); *E03C 1/057* (2013.01)

(58) Field of Classification Search

CPC ..... A47K 5/1217; B05B 7/0018; B05B 7/08
USPC ..... 222/26, 52, 129, 135, 144.5, 181.1, 222/181.3, 182, 185.1
See application file for complete search history.

(56) References Cited

U.S. PATENT DOCUMENTS

| | | | | |
|---|---|---|---|---|
| 4,642,821 A | | 2/1987 | Zanuso | |
| 4,722,372 A | * | 2/1988 | Hoffman | A47K 5/1209 137/562 |
| 4,895,276 A | * | 1/1990 | Maldonado | A47K 5/1215 222/144.5 |
| 5,649,334 A | | 7/1997 | Henriquez | |
| 5,836,482 A | * | 11/1998 | Ophardt | A47K 5/1202 222/325 |
| 6,390,329 B1 | * | 5/2002 | Maddox | A47K 5/1202 222/207 |
| 6,973,679 B1 | * | 12/2005 | Schad | E03D 9/085 4/420.4 |
| 7,086,567 B1 | * | 8/2006 | Ciavarella | A47K 5/1202 222/105 |
| 7,837,066 B2 | * | 11/2010 | Reynolds | A47K 5/1217 222/144.5 |
| 8,833,607 B2 | * | 9/2014 | Wegelin | B67D 1/0078 222/1 |
| 2009/0119142 A1 | | 5/2009 | Yenni | |

(Continued)

*Primary Examiner* — Vishal Pancholi

(57) ABSTRACT

The invention is directed to a touchless soap and water dispenser for a toilet stall. The dispenser provides an internal pair of reservoirs: a refillable water mister reservoir and a refillable or replaceable soap foam reservoir. Two nozzles, one connected to each reservoir, protrude from the bottom surface of the dispenser within a recess. Each nozzle is operated by a touch sensitive button, illuminated with a symbol identifying the contents of the connected reservoir. Only one of the nozzles may be activated at a time; activating one nozzle automatically deactivates the other, with an LED light illuminating the nozzle that is currently activated. Preferably, one or more infrared sensors are provided which detect the approach and stopping of a hand with toilet paper to dispense soap or water. If the hand or other object approaches too closely, a sliding security door is activated which covers the recess to protect the nozzles from vandalism or sabotage. All corners and edges of the cover of the dispenser are rounded, to prevent discomfort or injury to the user in the event of incidental contact.

6 Claims, 2 Drawing Sheets

(56) References Cited

U.S. PATENT DOCUMENTS

| | | | | |
|---|---|---|---|---|
| 2011/0027148 | A1* | 2/2011 | Zlatic | A47K 5/1202 422/266 |
| 2012/0048891 | A1* | 3/2012 | Hagleitner | A47K 5/16 222/52 |
| 2014/0076916 | A1* | 3/2014 | Boyce | A47K 10/38 221/34 |
| 2016/0052007 | A1* | 2/2016 | Fuller | B01F 5/061 222/1 |
| 2016/0374519 | A1* | 12/2016 | Murphy | A47K 5/1217 222/23 |

* cited by examiner

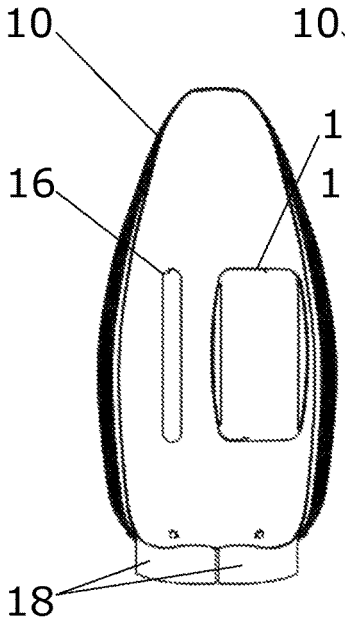
FIG.1
FIG.2
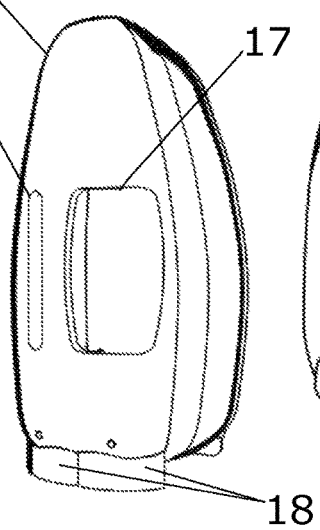
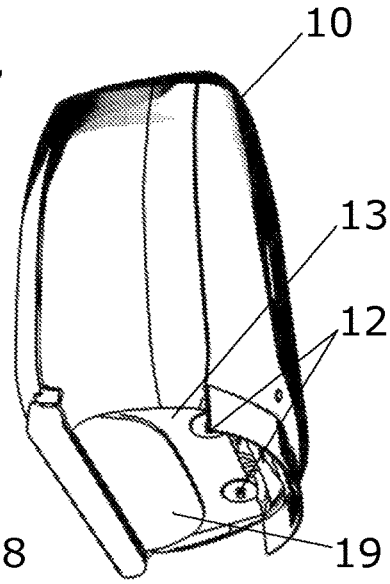
FIG.3
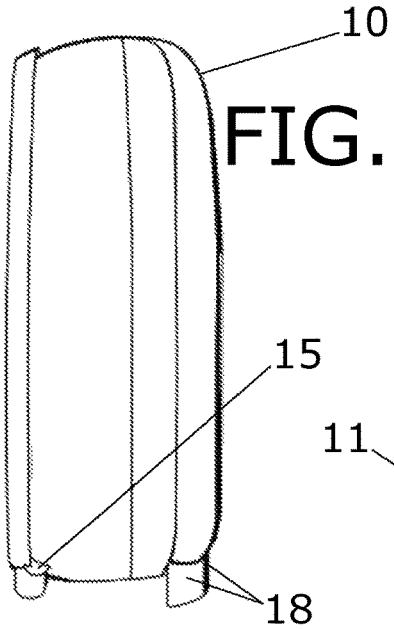
FIG.4
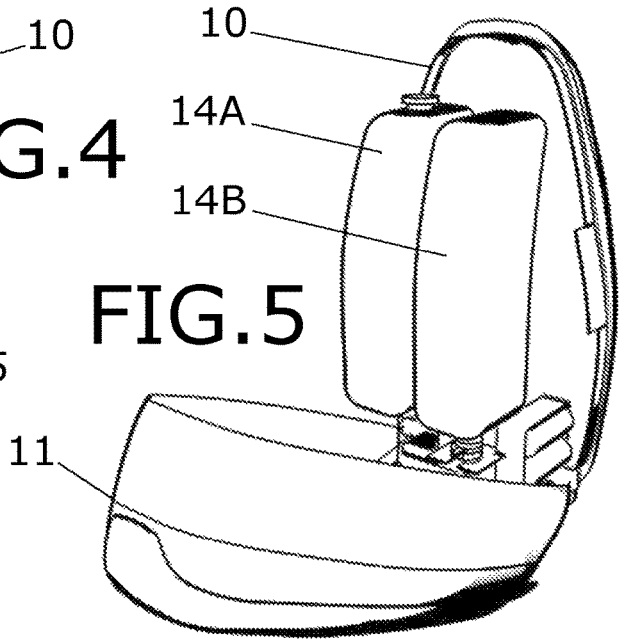
FIG.5

SOAP AND WATER DISPENSER FOR A TOILET STALL

CROSS-REFERENCE TO RELATED APPLICATIONS

This Application claims the benefit of U.S. Provisional Application No. 62/482,670, filed Apr. 6, 2017, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to public restroom equipment and accessories, and in particular to a touchless soap and water dispenser for a toilet stall. Currently in the United States, going to the restroom is a "dry" process. Individuals using public restroom facilities have no ability for personal cleansing after a bowel movement and wiping as normal. This invention can be used for personal hygiene, and facility cleanliness (prior to and after sitting down).

A few years ago, operators of many public restrooms installed increasingly popular personal wipes—pre-moistened towelettes that are often advertised as "flushable"—which were being blamed for creating clogs and backups in sewer systems around the nation. Bidets have been installed in most public restrooms in the Middle East, North Africa, Western Europe, East Asia, and Latin America. A bidet provides a stream of water which functions in a manner similar to toilet paper. However, managers of public buildings in North America have resisted the installation of bidets due to the substantial floor space and expense they would require.

Add-on devices to provide bidet-like functions on a conventional toilet are also expensive, and each design has proven to be less than satisfactory in its own way. As more and more immigrants come to North America, it has become more imperative to accommodate their public restroom needs as well.

A search of the prior art reveals various devices which have been developed to provide the features of a soap and water dispenser for a toilet stall. None are closely related to the present invention, but several include features which resemble those of the present invention. Each has proven to be less than satisfactory for the present purpose in its own way.

Water and soap dispensing scrubber apparatus, U.S. Pat. No. 5,649,334 (priority Mar. 7, 1996), provides a primary fluid, e.g. water, and auxiliary fluid, e.g. soap, dispensing scrubber apparatus includes a pistol-shaped housing which has a hand-grip portion and a scrubber-holder portion. A primary fluid conveyance assembly includes, in sequence, an inlet end, a pre-valve conduit, a valve assembly, a post-valve conduit, and an outlet end. A flexible hose has one end connected to the inlet end of the primary fluid conveyance assembly and has another end which includes a faucet connector. Rechargeable batteries are housed within the housing and power a DC motor. A trigger-containing switch assembly is connected between the motor and the batteries. A drive shaft is connected to the motor, and a scrubber head is connected to the drive shaft. A spray nozzle is connected to the outlet end of the post-valve conduit. The drive shaft is hollow and forms a portion of the post-valve conduit of the primary fluid conveyance assembly. A fluid-tight seal is connected between a lead-in portion of the post-valve conduit and the hollow drive shaft. A motor armature includes a hollow armature shaft which serves as the drive shaft and also forms a portion of the post-valve conduit of the primary fluid conveyance assembly. The scrubber head may be in the form of a brush or a sponge. A container assembly, connected to the housing, contains a quantity of an auxiliary fluid which is moved to the valve assembly through a feed tube.

Personal cleansing spray device, U.S. Pat. No. 6,973,679 (priority Jul. 2, 2004), provides a personal cleansing device that is low in cost, and simple to manufacture from standard components, that provides cleaning capabilities with water, and can provide a cleaning and antiseptic spray using a fluid-dispensing attachment. A water branch off valve is installed in flowable relation with the water supply line of a standard toilet. This valve supplies water to a flexible hose that may be retractable. This hose is connected to a manually operated sprayer nozzle having a trigger mechanism that may be used to turn the delivery of water on or off.

Restroom convenience center, U.S. Patent Appl. No. 2009/0119142 (priority Nov. 5, 2007), provides a restroom monitoring system for monitoring attributes of fixtures within a restroom using sensors. Additional attributes are determined from the monitored attributes. Consumable usage levels are estimated based on predetermined consumption levels associated with usage states of the fixtures. The restroom monitoring system provides an indication of the need for replenishment of consumables based on the monitored attributes of the fixtures. In addition, restroom monitoring system may provide additional information regarding the restroom attributes to a service provider, a manager or a user.

Self-cleaning sanitary apparatus, U.S. Pat. No. 4,642,821 (priority Jun. 28, 1982), provides a booth provided with an automatically openable door, and formed by an outer shell having an inner shell off-centered therein. Thereby between the two shells a space is defined, which accommodates devices for effecting the functions of the apparatus. The cited devices comprise an automatic dispenser of toilet paper, a hand washing compartment for the user, equipped with an automatic soap dispenser, and a plurality of flushing liquid dispensing nozzles arranged peripherally over the inner wall of the inner shell. The inner shell interior includes a bowl seat and a tilting footrest acting as a floor, which is connected to weight sensing members for a person, in turn connected to members controlling the cabin door opening and closing to only enable its use by a single person.

Device and method for dispensing liquid media, WIPO Patent No. WO2003106772 (priority Jun. 17, 2002), provides a fully or partially back-lightable hood or cover. The working or backlighting is preferably controllable in dependence on the presence of persons in the area of the device. By the action of the switching-on to light the attention of users who approach the valve can be directed to the device or the valve. The valve can be configured so that luminous information or advertising messages can be displayed on the inner or rear side of the hood or cover or projected, which also attract the user's attention. Alternatively, such information can also be projected by a viewing window in the hood to a nearby wall or a mirror. The information or advertising messages can be applied to easily replaceable transparent films or slides depending on the configuration of the device.

A simple and inexpensive device which enables the user to wash up in a standard toilet stall would be well received. A touchless soap and water dispenser for a toilet stall, which dispenses soap foam and water for the purpose of personal cleansing prior to emerging from the toilet stall, would resolve this problem.

SUMMARY OF THE INVENTION

Accordingly, the invention is directed to a touchless soap and water dispenser for a toilet stall. The dispenser provides an internal pair of reservoirs: a refillable water mister reservoir and a refillable or replaceable soap foam reservoir. Two nozzles, one connected to each reservoir, protrude from the bottom surface of the dispenser within a recess. Each nozzle is operated by a touch sensitive button, illuminated with a symbol identifying the contents of the connected reservoir. Only one of the nozzles may be activated at a time; activating one nozzle automatically deactivates the other, with an LED light illuminating the nozzle that is currently activated. Preferably, one or more infrared sensors are provided which detect the approach and stopping of a hand with toilet paper to dispense soap or water. If the hand or other object approaches too closely, a sliding security door is activated which covers the recess to protect the nozzles from vandalism or sabotage. All corners and edges of the cover of the dispenser are rounded, to prevent discomfort or injury to the user in the event of incidental contact.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 is a front view of the first exemplary embodiment, displaying the dispenser 10, the narrow window 16, the broad window 17, and the buttons 18.

FIG. 2 is a front perspective view of the first exemplary embodiment, displaying the dispenser 10, the narrow window 16, the broad window 17, and the buttons 18.

FIG. 3 is a bottom perspective view of the first exemplary embodiment, displaying the dispenser 10, the nozzles 12, the recess 13, the buttons 18, and the door 19.

FIG. 4 is a side view of the first exemplary embodiment, displaying the dispenser 10, the hinge 15, and the buttons 18.

FIG. 5 is a front perspective view of the first exemplary embodiment with the cover opened, displaying the dispenser 10, the cover 11, the water mister reservoir 14A, and the soap foam dispenser 14B.

DETAILED DESCRIPTION OF THE INVENTION

Figure 6:
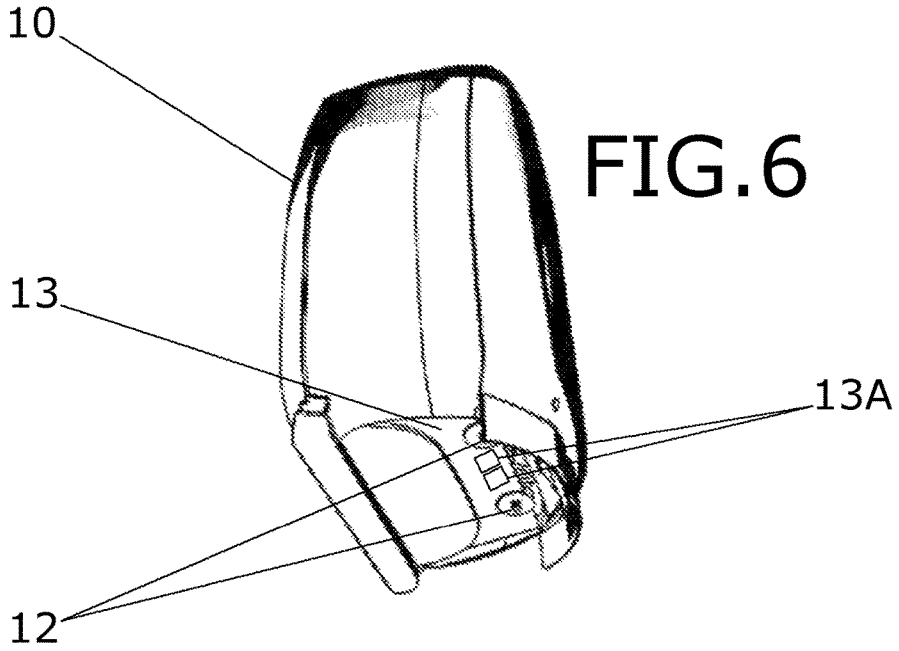
FIG. 6 is a bottom perspective view of the first exemplary embodiment. displaying the dispenser 10, the nozzles 12, the recess 13, and the LED lights 13A.
Figure 7:
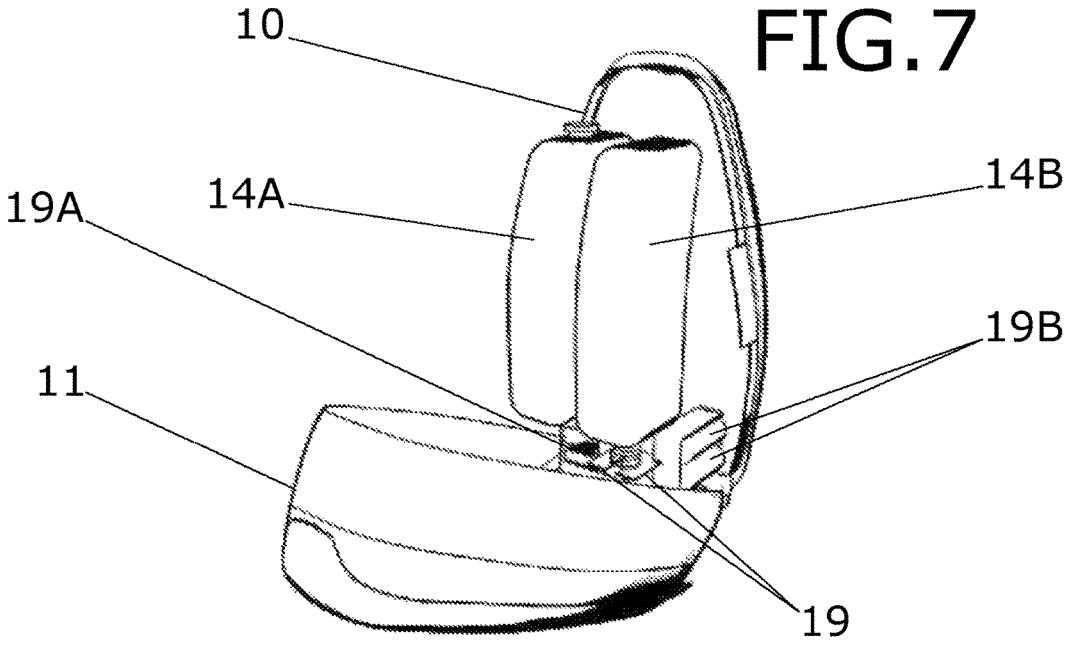
FIG. 7 is a side perspective view of the first exemplary embodiment with the cover opened, displaying the dispenser 10, the cover 11, the water mister reservoir 14A, the soap foam dispenser 14B, the sensors 19, the servomoters 19A and the batteries 19B.

Referring now to the invention in more detail, the invention is a soap and water dispenser 10 for a toilet stall. The dispenser 10 enables the management of a building providing public restrooms to provide convenient facilities for limited personal cleansing with soap foam and water in the privacy of a toilet stall, saving the substantial floor space and expense required to install bidets. The dispenser 10 enables personal cleansing after a bowel movement and wiping as normal. The invention may be used for personal hygiene, and facility cleanliness (prior to and after sitting down). The dispenser 10 may be mounted on a side partition, or on the interior surface of the door of the toilet stall. The dispenser 10 is intended to be used for personal hygiene and facilities cleanliness. After a bowel movement and wiping as normal, the user may use the dispenser 10 to freshen up.

The dispenser 10 provides an internal pair of reservoirs: a refillable water mister reservoir 14A and a refillable or replaceable soap foam reservoir 14B. Two nozzles 12, one connected to each reservoir, protrude from the bottom surface of the dispenser 10 within a recess 13. Each nozzle 12 is operated by a touch sensitive button 18, illuminated with a symbol identifying the contents of the connected reservoir. Only one of the nozzles 12 may be activated at a time; activating one nozzle 12 automatically deactivates the other, with an LED light 13A illuminating the nozzle 12 that is currently activated.

Preferably, one or more infrared sensors 19 are provided which detect the approach of a hand or other object to dispense soap foam or water. If the object approaches too closely to the nozzles 12, a sliding security door 19 is activated by the sensors 19, which covers the recess 13 to protect the nozzles 12 from vandalism. The front, side, and top surfaces of the dispenser 10 comprise a cover 11, which opens downward and forward, and is secured to the dispenser 10 with a hinge 15 along the bottom rear edge. All corners and edges of the cover 11 of the dispenser 10 are rounded, to prevent discomfort or injury to the user in the event of incidental contact. Servomotors 19A dispense the soap foam and water mist.

A narrow window 16 and a broad window 17 are provided on the front surface of the cover 11, such that levels of water and soap foam, respectively, in the reservoirs may be monitored. The servomotors 19A, LED lights 13A, and sensors 19 are preferably powered by replaceable batteries 19B.

To use the first exemplary embodiment, the user may tap one of the buttons 18 corresponding to the substance which the user first desires to be dispensed. The user holds the other hand with 4-6 folded squares of 2-ply toilet paper beneath the dispenser 10 to receive the water mist or soap foam. The user then applies the soap or water and disposes the toilet paper in the toilet (Dispense, Apply, Dispose). When the user wishes to switch to dispensing the other substance, the user simply taps the other button 18 and repeats the process above with new toilet paper (Dispense, Apply, Dispose). Double tapping one or both buttons deactivates the dispenser 10 completely. Also, the dispenser will automatically deactivate itself after a predetermined period of non-use, such as 3 minutes.

The dispenser 10, the cover 11, the nozzles 12, the LED lights 13A, the hinge 15, the door 19, the sensors 19 the LED lights, and the servomotors 19A are preferably manufactured from rigid, durable materials, such as steel, aluminum alloy, and plastic. The water mister reservoir 14A, the soap foam reservoir 14B, the narrow window 16, and the broad window 17 are preferably manufactured from a rigid, durable material which is transparent or translucent, such as transparent or translucent plastic.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A touchless soap and water dispenser for a toilet stall, comprising:

an internal pair of reservoirs which include a refillable water mister reservoir and a refillable or replaceable soap foam reservoir connected to respective nozzles which extend and protrude from a surface on which the pair of reservoirs are positioned;

a cover that includes a front portion and a rear portion that encapsulate the internal pair of reservoirs in a closed position, the cover having an opening through which at least a portion of the surface associated with the pair of reservoirs is exposed and which further exposes the nozzles that protrude from the surface, the opening extending between the front and rear portions of the cover and on a bottom of the cover, and wherein the front and rear portions of the cover open and close by rotating about a hinge;

a sliding door that is attached to the cover and which is positioned adjacent to the surface associated with the reservoirs, the sliding door moves in a back and forth motion that protects or exposes the nozzles depending on the sliding door's positioning; and one or more infrared sensors provided in an array around the nozzles which detect approaching and stopping of a hand to dispense soap or water using battery-powered servomotors, and wherein responsive to the hand or other object approaching within a detectable distance to the one or more infrared sensors, the sliding door is activated which covers the recess to protect the nozzles from vandalism or sabotage.

2. The dispenser of claim 1, wherein each nozzle is operated by a touch sensitive button with a symbol identifying the contents of the respective reservoir.

3. The dispenser of claim 1, wherein the cover opens in a downward and forward motion and is secured to the dispenser with a hinge along the bottom rear edge of the cover.

4. The dispenser of claim 1, wherein all corners and edges of the cover of the dispenser are rounded, to prevent discomfort or injury to the user in the event of incidental contact.

5. The dispenser of claim 1, in which the rear portion of the cover extends parallel to and is positioned on a rear side of the reservoirs, and the front portion encapsulates the reservoirs from a front, top, left, and right sides thereof.

6. The dispenser of claim 5, in which the front and rear portions of the cover engage near a rear of the reservoirs.

* * * * *